US008821648B2

(12) United States Patent
Lourenco

(10) Patent No.: US 8,821,648 B2
(45) Date of Patent: Sep. 2, 2014

(54) PREPARATIONS FOR ALL-PURPOSE CLEANING COMPOSITIONS

(75) Inventor: Wagner Lourenco, Campinas Sao Paulo (BR)

(73) Assignee: Rhodia Poliamida e Especialidades Ltda, Sao Paulo-SP (BR)

( * ) Notice: Subject to any disclaimer, the term of this patent is extended or adjusted under 35 U.S.C. 154(b) by 0 days.

(21) Appl. No.: 14/110,236

(22) PCT Filed: Apr. 10, 2012

(86) PCT No.: PCT/IB2012/000717

§ 371 (c)(1), (2), (4) Date: Oct. 7, 2013

(87) PCT Pub. No.: WO2012/143769

PCT Pub. Date: Oct. 26, 2012

(65) Prior Publication Data

US 2014/0031271 A1 Jan. 30, 2014

(30) Foreign Application Priority Data

Apr. 18, 2011 (FR) ..... 11 53331

(51) Int. Cl.

| | |
|---|---|
| ***C11D 3/20*** | (2006.01) |
| ***C11D 3/43*** | (2006.01) |
| ***B08B 3/04*** | (2006.01) |
| ***C11D 11/00*** | (2006.01) |
| ***C11D 7/50*** | (2006.01) |

(52) U.S. Cl.

CPC ..... *C11D 7/5022* (2013.01); *C11D 3/2096* (2013.01); *C11D 11/0023* (2013.01); *C11D 3/43* (2013.01); *C11D 11/0052* (2013.01); *C11D 3/2075* (2013.01)

USPC ..... 134/39; 134/25.2; 134/25.3; 134/40; 134/42; 510/238; 510/240; 510/245; 510/434; 510/477; 510/488; 510/505

(58) Field of Classification Search

CPC ..... C11D 3/20; C11D 3/2075; C11D 3/43; C11D 7/265; C11D 7/267; C11D 7/5022; B08B 3/04

USPC ..... 510/238, 240, 245, 434, 477, 488, 505; 134/25.2, 25.3, 39, 40, 42

See application file for complete search history.

(56) References Cited

U.S. PATENT DOCUMENTS

| | | | | |
|---|---|---|---|---|
| 2008/0280997 | A1 | 11/2008 | Rodier et al. | |
| 2010/0137480 | A1 * | 6/2010 | Denilson et al. | 524/108 |
| 2012/0129744 | A1 * | 5/2012 | McDougall | 508/307 |
| 2012/0223268 | A1 | 9/2012 | Bonifacio Hauffe et al. | |
| 2012/0270995 | A1 | 10/2012 | Bonifacio et al. | |

FOREIGN PATENT DOCUMENTS

| | | | |
|---|---|---|---|
| JP | H 083590 | A | 1/1996 |
| JP | 11 217325 | A | 8/1999 |
| WO | WO 2005105149 | A1 | 11/2005 |
| WO | WO 2008096255 | A2 | 8/2008 |
| WO | WO 2010138907 | A1 | 12/2010 |
| WO | WO 2011027205 | A1 | 3/2011 |
| WO | WO 2011048481 | A1 | 4/2011 |

OTHER PUBLICATIONS

ASTM—D5343-06—"Standard Guide for Evaluating Cleaning Performance of Ceramic Tile Cleaners", 2006, ASTM International Designation; pp. 1-5 (5 pgs).

Allured, M.—McCutcheon's Emulsifieds & Detergents, 1999 International Edition; "Ionic Type Classification", pp. 243-253; McCutcheon Div. Mc. Pub. Co. (11 pgs).

Allured, M.—McCutcheon's Emulsifiers & Detergents, 1999 North America Edition; "Ionic Type Classification", pp. 283-293; McCutcheon Div. Mc. Pub. Co. (11 pgs).

* cited by examiner

*Primary Examiner* — Brian P Mruk

(74) *Attorney, Agent, or Firm* — Beatrice C. Ortego

(57) ABSTRACT

Multi-purpose cleaning compositions, in particular multi-purpose aqueous alkaline compositions for cleaning surfaces, and base preparations for this purpose. Such base preparations comprise one or more solvents that are at least partially water-miscible, one or more alkali metal salts of carboxylic acids, and water. Such multi-purpose cleaning compositions comprise at least such base preparation, a surfactant, a basifying agent, and water.

20 Claims, No Drawings

PREPARATIONS FOR ALL-PURPOSE CLEANING COMPOSITIONS

CROSS-REFERENCE TO RELATED APPLICATIONS

The present application is a U.S. national stage entry under 35 U.S.C. §371 of International Application No. PCT/IB2012/000717 filed Apr. 10, 2012, which claims priority to French Application No. 11.53331 filed on Apr. 18, 2011, the whole content of this application being herein incorporated by reference for all purposes.

TECHNICAL FIELD OF THE INVENTION

The present invention relates to multi-purpose cleaning compositions, in particular multi-purpose aqueous alkaline compositions for cleaning surfaces, and to the base preparations for this purpose. The base preparations of the present invention comprise one or more solvents that are at least partially water-miscible, one or more alkali metal salts of carboxylic acids and water. The compositions of the present invention comprise at least the said base preparation, a surfactant, a basifying agent and water.

BACKGROUND OF THE INVENTION

Multi-purpose cleaning agents are designed to clean several different types of washable hard surface. The benefits of multi-purpose cleaning agents are that they offer consumers a cleaning product that can be used throughout the majority of the house. For example, multi-purpose cleaning agents may be used for wiping down and cleaning work surfaces, bathroom surfaces such as floors, walls, windows, kitchen equipment, etc.

A large variety of cleaning compositions intended for cleaning hard surfaces, such as the surfaces usually encountered in kitchens and bathrooms, is known in the field.

The products for cleaning hard surfaces usually referred to as multi-purpose cleaning agents are products whose main attribute is their efficacy for cleaning all kinds of surfaces, although the odour, the anti-grease effect, the price, the quality and the practical use are also very important.

Multi-purpose cleaning agents contain ingredients that act as humectants for water-insoluble soiling, for example oils, waxes and grease particles, reducing their affinity with the surface undergoing cleaning and keeping all the substances in suspension until they are eliminated, for example by rubbing a fabric.

These properties are further improved by means of the starting materials used in the composition, such as surfactants, solvents, sequestrants, alkaline agents, solubilizers, preserving agents, bactericides, fragrances, dyes and water. The solvent contained in these formulations is important in the final application of this type of product, on account of its impact on the use, the toxicity and the final dry effect.

Solvents are of fundamental importance in formulations of this type, since they act with the surfactants in reducing the surface tension of water and in solubilizing the water-soluble and water-insoluble soiling materials. Moreover, as they are amphiphilic molecules, they act as micelle promoters, which reduce the repulsion of the hydrophilic heads of the anionic surfactants. They also control evaporation and have the capacity of acting as hydrotropes by changing the polarity of the suspension/solution. Furthermore, solvents and alkaline agents increase the transparency of the system.

Consequently, there is ongoing research into novel and more efficient solutions for multi-purpose household cleaning products.

DESCRIPTION OF THE INVENTION

It has been found that the use of at least one solvent, that is at least partially water-miscible, in admixture with at least one alkali metal salt of a carboxylic acid, enables the preparation of multi-purpose cleaning compositions with improved cleaning power. The present invention relates to multi-purpose surface cleaners, which are particularly useful for cleaning soiled and oily surfaces.

In a first aspect, the present invention relates to a base aqueous preparation for multi-purpose cleaning compositions, comprising at least:

(A) one solvent being at least partially water-miscible, and (B) one alkali metal salt of a carboxylic acid.

In another aspect, the present invention relates to multi-purpose aqueous cleaning compositions, especially for hard surfaces, comprising at least the base preparation as described above, a surfactant, a basifying agent and water.

The present invention also relates to multi-purpose cleaning compositions, especially for hard surfaces, comprising at least:

(A) one solvent being at least partially water-miscible, (B) one alkali metal salt of a carboxylic acid, (C) one surfactant, (D) one basifying agent, and (E) water.

The present invention also relates to the use of the cleaning composition for cleaning surfaces, especially hard surfaces.

The term "partially water-miscible" should be understood as relating to the ability to be dissolved in water at concentrations much lower than a certain critical concentration, while the concentration increases the latter exceeding a certain critical value, phase separation takes place and the water and the solvent form two distinct phases.

In accordance with the invention, said solvent being at least partially water-miscible is chosen from the dioxolanes defined in formula (I) below:

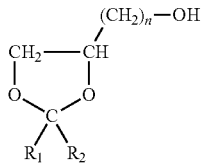

(I)

in which R1 and R2, identical or different, represent hydrogen or a group chosen from at least one alkyl, alkenyl or phenyl group and n is an integer equal to 1, 2, 3, 4 or 5.

The dioxolanes are especially those that are produced by reacting glycerol with aldehydes or ketones, in particular acetone, methyl isobutyl ketone or diisobutyl ketone.

In one particular embodiment according to the present invention, R1 and R2 are chosen from the group comprising: a methyl, ethyl, n-propyl, isopropyl or isobutyl group, and preferentially n is 1 or 2.

Among the dioxolanes that are useful in the present invention, examples that may be mentioned include:

2-hydrocarbyl-1,3-dioxolane-4-methanol, for example:

2,2-dimethyl-1,3-dioxolane-4-methanol 2,2-diisobutyl-1,3-dioxolane-4-methanol 2-isobutyl-2-methyl-1,3-dioxolane-4-methanol
2-butyl-2-ethyl-1,3-dioxolane-4-methanol, and
2-phenyl-1,3-dioxolane-4-methanol Advantageously, the said aqueous preparation contains several at least partially water-miscible solvents. More particularly, besides the presence of at least one solvent chosen from the dioxolanes of formula (I), the said preparation contains at least one cosolvent chosen from dioxolane derivatives, glycol ethers, especially glycol mono-, di- or triethers, alcohols such as C1-C6 alcohols and glycols such as C2-C6 glycols.

Among the glycol mono-, di- or triethers that are useful in the present invention, examples that may be mentioned, without this list being limiting, include:
ethylene glycol monobutyl (or n-butyl or t-butyl) ether
ethylene glycol monoethyl ether
ethylene glycol monopropyl (or isopropyl) ether
ethylene glycol monophenyl ether
ethylene glycol monobenzyl ether
ethylene glycol hexyl ether
diethylene glycol monoethyl ether
diethylene glycol mono-n-butyl ether
diethylene glycol diethyl ether
diethylene glycol dimethyl ether
ethylene glycol diethyl ether
ethylene glycol dibutyl ether
ethylene glycol methyl ether acetate
ethylene glycol monoethyl ether acetate
ethylene glycol monobutyl ether acetate
propylene glycol monobutyl (or isobutyl or t-butyl) ether
propylene glycol monoethyl ether
propylene glycol monomethyl ether
propylene glycol mono-n-propyl ether
propylene glycol monophenyl ether
propylene glycol dimethyl ether
dipropylene glycol monomethyl ether, and
triethylene glycol monobutyl ether.

The C1-C6 alcohols may in particular be ethanol, propanol or isopropanol, and/or mixtures thereof.

The C2-C6 glycols may in particular be ethylene glycol, propylene glycol or hexylene glycol, and/or mixtures thereof.

The carboxylic acid in the alkali metal salt of a carboxylic acid may comprise from 1 to 10 carbon atoms. Carboxylic acids that are mono-, di- or tricarboxylic acids are especially preferred, for example C1-C3 monocarboxylic acids, i.e., acids comprising from 1 to 3 carbon atoms, especially acetates.

The appropriate alkali metals for these carboxylic acid metal salts are, for example, sodium or potassium.

Among the carboxylic salts, mention may be made, without this list being limiting, of:
sodium or potassium oxalate
sodium or potassium acetate
sodium or potassium propionate
sodium or potassium adipate
sodium or potassium glutarate, and
sodium or potassium succinate.

Advantageous water/salt ratios used in the base preparations of the present invention range from 3.3/1 to 7.6/1.

Adequate weight percentages for the solvent(s) (A) relative to the total weight of the base preparation of the present invention range from 77% to 40%.

Adequate weight percentages for the alkali metal salt(s) of a carboxylic acid, relative to the total weight of the base preparation of the present invention, range from 2.7% to 10%.

As examples of adequate solvent/water/salt ratios used in the base preparations of the present invention, mention may be made, without this list being limiting, of the following:
50/40/10
40/50/10
70/25/5
76.9/19.2/3.8

In the compositions of the present invention, the solvent content conveniently represents from 0.1% to 6% by weight relative to the total weight of the composition. The alkali metal salt content conveniently represents from 0.1% to 2% by weight relative to the total weight of the composition.

When they are manufactured from the base preparations of the present invention, the compositions of the present invention generally comprise 5% to 10% by weight of these base preparations.

A wide variety of surfactants (C) may be used in the compositions of the present invention, such as nonionic, anionic, cationic and amphoteric surfactants, and mixtures thereof. Examples of such surfactants are described in the publication by McCutcheon: Emulsifiers & Detergent, North American Edition (1995).

The appropriate nonionic surfactants comprise alkylamine oxides, for example C8-20 alkyldimethylamine oxides, alkylphenol ethoxylates, linear and branched alcohol ethoxylates, carboxylic acid esters, alkanolamides, alkylpolyglycosides, copolymers of ethylene oxide/propylene oxide, etc. Among these surfactants, linear and secondary alcohol ethoxylates, octylphenol and nonylphenol ethoxylates, alkanolamides and alkylpolyglycosides are particularly preferred. The zwitterionic/amphoteric surfactants that are useful comprise alkylaminopropionic acids, alkyliminopropionic acids, imidazoline carboxylates, alkylbetaines, sulfobetaines and sultaines. The cationic surfactants that are useful comprise primary amine salts, diamine salts, quaternary ammonium salts and ethoxylated amines. The anionic surfactants that are useful, which are preferably used only in combination with a nonionic surfactant, comprise carboxylic acid salts, alkylbenzene sulfonates, alkylbenzenesulfonic acid, secondary n-alkanesulfonates, α-olefin sulfonates, dialkyl oxydiphenylene sulfonates, sulfosuccinate esters, isethionates, linear alcohol sulfates such as alkyl sulfates, for instance sodium lauryl sulfate, and linear ethoxyalcohol sulfates.

The compositions typically comprise from 2% to 4% by weight of surfactants.

The basifying agent (D) used in the compositions of the present invention is any chemical compound or group of compounds that are capable of increasing the pH of the medium of the composition to above 7. Suitable examples that may be mentioned, without this list being limiting, include sodium hydroxide, potassium hydroxide, ammonium hydroxide, trisodium phosphate, and mono-, di- or triethanolamine, and mixtures thereof. A suitable amount of basifying agent may be necessary to bring the pH to 8-12.

The amount of water is the amount that is necessary to achieve 100% of the weight of the compositions of the present invention.

The compositions of the present invention optionally comprise other ingredients such as, without this list being limiting, pH buffers, fragrances, fragrance solubilizers, viscosity modifiers, optical brighteners, opacifiers, enzymes, antistain agents, preserving agents, dyes, hydrotropes, antifoams, antioxidants, anticorrosion agents, enzymes and sequestrants. The total amounts of these optional additives are generally less than 2% by weight relative to the total weight of the composition.

Non-limiting examples of surfaces that may be treated using the compositions of the present invention are surfaces of refractory materials such as glazed and unglazed tiles, bricks, porcelain, ceramic and stone, marble, granite, stones and other surfaces; glass, metals, plastics, for example polyester, vinyl, glass fibre, Formica®, Corian® and other known hard surfaces used in cupboards and work surfaces and also wall and floor surfaces.

The compositions of the present invention also find a use in the cleaning of metallic surfaces outside and inside kitchen and bathroom appliances, for example the metal surfaces of kitchen appliances, including, without being limited thereto, polished, chromium-plated, burnished surfaces or mat or brushed-metal surfaces as found on kitchen work surfaces, electrical appliance cases, the surfaces of appliances including external appliance surfaces such as doors, and also internal surfaces such as the internal spaces of dishwashers, ovens and cooking hobs.

The compositions of the present invention afford the cleaning and reduction of stains, tarnishing or other discolorations of metal, such as those caused by the accumulation of soiling and grease or the oxidation of treated metal surfaces. Non-limiting examples of metals that may be mentioned include aluminium, copper, steel, stainless steel, brass and metal alloys that may comprise one or more of the abovementioned metals, and also non-metallic substrates with a metallic or metallized surface.

Specific language is used in the description so as to facilitate the understanding of the principle of the invention. It should, however, be understood that no limitation of the scope of the invention is envisaged by the use of this specific language. Modifications, improvements and perfections may especially be envisaged by a person skilled in the technical field concerned, on the basis of his own general knowledge.

The term "and/or" includes the meanings "and", "or" and also all the other possible combinations of elements connected to this term.

Other details or advantages of the invention will emerge more clearly in the light of the examples given below, purely for indicative purposes.

Experimental Section

To perform a comparative performance test, a basic formulation of a multi-purpose cleaning agent was used, as shown in Table I below:

TABLE I

Multi-purpose base formulation

| PRODUCT | Weight % |
|---|---|
| 50% sodium hydroxide | 0.42 |
| 96% sulfonic acid | 1.60 |
| 99% monoethanolamine | 0.25 |
| 96% ethanol | 1.00 |
| Solvent (*) | 0 to 6 |
| Lauryl alcohol 10 OE | 0.05 |
| 40% EDTA | 0.30 |
| Water | qs 100 |
| pH (100%) | 9.5-12.0 |

(*) pure solvent or solvent + additive according to the examples given below.

The test for evaluating the cleaning efficacy and the materials for performing the test are described below.

Cleaning Efficacy—Evaluation Method

The cleaning efficacy was evaluated using a modified method described in standard ASTM D 5343-06 "Standard Guide for Evaluating Cleaning Performance of Ceramics Tile Cleaners".

Preparation of Synthetic Soiling

Stearic acid (21.9 g) and carbon black (60.3 g) are added to a ceramic mortar. The two components are mixed together using a pestle, in order to obtain a homogeneous powder. 17.8 g of soybean oil are then added and mixed in until a homogeneous paste is obtained.

Preparation of the Test Substrate

The test substrate is a 15 cm×15 cm×2 mm vinyl tile. The surface of the substrate is cleaned with ethanol and left to dry in the open air for 2 hours. The reflectance is measured, the reading being defined as Ro=Original Reflectance.

Application of the Synthetic Soiling

A small amount of petroleum ether is added to 0.3 g of synthetic soiling and the mixture is applied to a 9×15 cm surface, so as to obtain a uniform layer. The vinyl tile is left to dry in the open air for 24 hours, and the reflectance is then measured, the reading being defined as Rd=Reflectance after Soiling.

15 readings were taken on each tile, and each evaluation being related to three tiles.

Cleaning Test

The dirty vinyl tile is placed in the hole at the centre of the tile support, and 10 ml of the product to be evaluated are applied to the surface of the dirty vinyl tile. A sponge (Scotch Brite® polyurethane sponge) is placed in a standard sponge holder of the linear washing machine. The abrasion speed of the washing machine is set at 15 cycles. After 15 cycles, the sponge is replaced with another one, 10 ml of the product to be evaluated are then added and the 15 cycles are repeated. The vinyl tile is left to dry in the open air for 24 hours, and the reflectance is then measured. The reading is defined as Rc=Reflectance after Cleaning.

The cleaning efficacy is calculated as follows:

$$\text{Cleaning efficacy}=(Rc-Rd)/(Ro-Rd)\times 100(\text{in }\%)$$

in which:

Rc=Reflectance after Cleaning

Ro=Original Reflectance

Rd=Reflectance after Soiling.

In all the examples that follow, the multi-purpose cleaning formulations were evaluated for their cleaning efficacy according to the modified standard ASTM D5343-06, as described.

EXAMPLE 1

955.8 g of water were added to a reactor, and the components indicated below were then added in the following order: aqueous 50% sodium hydroxide solution (4.2 g), 96% sulfonic acid (16 g), 99% monoethanolamine (2.5 g), 96% ethanol (10 g), 2-isobutyl-2-methyl-1,3-dioxolane-4-methanol (8 g), ethoxylated lauryl alcohol 10 OE (0.5 g), aqueous 40% solution of the sodium salt of ethylenediaminetetraacetic acid (3 g). The solution was stirred for 5 to 10 minutes, and a clear solution was obtained.

EXAMPLES 2 to 4

The formulation is as described in Example 1, except that the 2-isobutyl-2-methyl-1,3-dioxolane-4-methanol was replaced with 2,2-dimethyl-1,3-dioxolane-4-methanol (Ex. 2), ethylene glycol monobutyl ether (Ex. 3) and propylene glycol monobutyl ether (Ex. 4).

EXAMPLE 5

963.8 g of water were added to a reactor with stirring, and the components indicated below were then added in the following order: aqueous 50% sodium hydroxide solution (4.2 g), 96% sulfonic acid (16 g), 99% monoethanolamine (2.5 g), 96% ethanol (10 g), ethoxylated lauryl alcohol 10 OE (0.5 g), aqueous 40% solution of the sodium salt of ethylenediaminetetraacetic acid (3 g). The solution was stirred for 5 minutes, and a clear solution was obtained.

EXAMPLE 6

953.8 g of water were added to a reactor with stirring, and the components indicated below were then added in the following order: aqueous 50% sodium hydroxide solution (4.2 g), 96% sulfonic acid (16 g), 99% monoethanolamine (2.5 g), 96% ethanol (10 g), 2-isobutyl-2-methyl-1,3-dioxolane-4-methanol (8 g), sodium acetate (2 g), ethoxylated lauryl alcohol 10 OE (0.5 g), aqueous 40% solution of the sodium salt of ethylenediaminetetraacetic acid (3 g). The solution was stirred until dissolution of the components was complete, and a clear solution was obtained.

EXAMPLE 7

953.8 g of water were added to a reactor with stirring, and the components indicated below were then added in the following order: aqueous 50% sodium hydroxide solution (4.2 g), 96% sulfonic acid (16 g), 99% monoethanolamine (2.5 g), 96% ethanol (10 g), 2,2-dimethyl-1,3-dioxolane-4-methanol (8 g), sodium acetate (2 g), ethoxylated lauryl alcohol 10 OE (0.5 g), aqueous 40% solution of the sodium salt of ethylenediaminetetraacetic acid (3 g) and the solution was stirred until dissolution was complete, after which a clear solution was obtained.

EXAMPLE 8

900 g of water were added to a reactor with stirring, and the components indicated below were then added in the following order: aqueous 50% sodium hydroxide solution (4.2 g), 96% sulfonic acid (16 g), 99% monoethanolamine (2.5 g), 96% ethanol (10 g), 2-isobutyl-2-methyl-1,3-dioxolane-4-methanol (20 g), ethoxylated lauryl alcohol 10 OE (0.5 g), aqueous 40% solution of the sodium salt of ethylenediaminetetraacetic acid (3 g). Water was added to make up to 1000 g and the solution was stirred for 10 minutes, after which a clear solution was obtained.

EXAMPLES 9 to 11

The formulations are as described in Example 8, except that the 2-isobutyl-2-methyl-1,3-dioxolane-4-methanol was replaced with 2,2-dimethyl-1,3-dioxolane-4-methanol (Ex. 9), ethylene glycol monobutyl ether (Ex. 10) and propylene glycol monobutyl ether (Ex. 11).

EXAMPLE 12

900 g of water were added to a reactor with stirring, and the components indicated below were then added in the following order: aqueous 50% sodium hydroxide solution (4.2 g), 96% sulfonic acid (16 g), 99% monoethanolamine (2.5 g), 96% ethanol (10 g), 2-isobutyl-2-methyl-1,3-dioxolane-4-methanol (16 g), sodium acetate (4 g), ethoxylated lauryl alcohol 10 OE (0.5 g), aqueous 40% solution of the sodium salt of ethylenediaminetetraacetic acid (3 g). Water was added to make up to 1000 g and the solution was stirred for 10 minutes, after which a clear solution was obtained.

EXAMPLE 13

900 g of water were added to a reactor with stirring, and the components indicated below were then added in the following order: aqueous 50% sodium hydroxide solution (4.2 g), 96% sulfonic acid (16 g), 99% monoethanolamine (2.5 g), 96% ethanol (10 g), 2,2-dimethyl-1,3-dioxolane-4-methanol (16 g), sodium acetate (4 g), ethoxylated lauryl alcohol 10 OE (0.5 g), aqueous 40% solution of the sodium salt of ethylenediaminetetraacetic acid (3 g). Water was added to make up to 1000 g and the solution was stirred for 10 minutes, after which a clear solution was obtained.

EXAMPLE 14

1900 g of water were added to a reactor with stirring, and the components indicated below were then added in the following order: aqueous 50% sodium hydroxide solution (8.4 g), 96% sulfonic acid (32 g), 99% monoethanolamine (5 g), 96% ethanol (20 g), 2-isobutyl-2-methyl-1,3-dioxolane-4-methanol (80 g), ethoxylated lauryl alcohol 10 OE (1 g), aqueous 40% solution of the sodium salt of ethylenediaminetetraacetic acid (6 g). Water was added to make up to 2000 g and the solution was stirred for 10 minutes, after which a clear solution was obtained.

EXAMPLES 15 TO 17

The formulations are as described in Example 14, except that the 2-isobutyl-2-methyl-1,3-dioxolane-4-methanol was replaced with 2,2-dimethyl-1,3-dioxolane-4-methanol (Ex. 15), ethylene glycol monobutyl ether (Ex. 16) and propylene glycol monobutyl ether (Ex. 17).

EXAMPLE 18

850 g of water were added to a reactor with stirring, and the components indicated below were then added in the following order: aqueous 50% sodium hydroxide solution (4.2 g), 96% sulfonic acid (16 g), 99% monoethanolamine (2.5 g), 96% ethanol (10 g), 2-isobutyl-2-methyl-1,3-dioxolane-4-methanol (40 g), sodium acetate (10 g), ethoxylated lauryl alcohol 10 OE (0.5 g), aqueous 40% solution of the sodium salt of ethylenediaminetetraacetic acid (3 g). Water was added to make up to 1000 g and the solution was stirred for 10 minutes, after which a clear solution was obtained.

EXAMPLE 19

850 g of water were added to a reactor with stirring, and the components indicated below were then added in the following order: aqueous 50% sodium hydroxide solution (4.2 g), 96% sulfonic acid (16 g), 99% monoethanolamine (2.5 g), 96% ethanol (10 g), 2,2-dimethyl-1,3-dioxolane-4-methanol (40 g), sodium acetate (10 g), ethoxylated lauryl alcohol 10 OE (0.5 g), aqueous 40% solution of the sodium salt of ethylenediaminetetraacetic acid (3 g). Water was added to make up to 1000 g and the solution was stirred for 10 minutes, after which a clear solution was obtained.

EXAMPLE 20

4500 g of water were added to a reactor with stirring, and the components indicated below were then added in the following order: aqueous 50% sodium hydroxide solution (21 g), 96% sulfonic acid (80 g), 99% monoethanolamine (12.5 g), 96% ethanol (50 g), 2-isobutyl-2-methyl-1,3-dioxolane- 4-methanol (300 g), ethoxylated lauryl alcohol 10 OE (2.5 g), aqueous 40% solution of the sodium salt of ethylenediaminetetraacetic acid (15 g). Water was added to make up to 5000 g and the solution was stirred for 10 minutes, after which a clear solution was obtained.

EXAMPLES 21 TO 23

The formulations are as described in Example 20, except that the 2-isobutyl-2-methyl-1,3-dioxolane-4-methanol was replaced with 2,2-dimethyl-1,3-dioxolane-4-methanol (Ex. 21), ethylene glycol monobutyl ether (Ex. 22) and propylene glycol monobutyl ether (Ex. 23).

EXAMPLE 24

900 g of water were added to a reactor with stirring, and the components indicated below were then added in the following order: aqueous 50% sodium hydroxide solution (4.2 g), 96% sulfonic acid (16 g), 99% monoethanolamine (2.5 g), 96% ethanol (10 g), 2-isobutyl-2-methyl-1,3-dioxolane-4-methanol (48 g), sodium acetate (12 g), ethoxylated lauryl alcohol 10 OE (0.5 g), aqueous 40% solution of the sodium salt of ethylenediaminetetraacetic acid (3 g). Water was added to make up to 1000 g and the solution was stirred for 10 minutes, after which a clear solution was obtained.

EXAMPLE 25

850 g of water were added to a reactor with stirring, and the components indicated below were then added in the following order: aqueous 50% sodium hydroxide solution (4.2 g), 96% sulfonic acid (16 g), 99% monoethanolamine (2.5 g), 96% ethanol (10 g), 2,2-dimethyl-1,3-dioxolane-4-methanol (48 g), sodium acetate (12 g), ethoxylated lauryl alcohol 10 OE (0.5 g), aqueous 40% solution of the sodium salt of ethylenediaminetetraacetic acid (3 g). Water was added to make up to 1000 g and the solution was stirred for 10 minutes, after which a clear solution was obtained.

The Cleaning efficacy results are given in Table II below.

TABLE II

| | | EXAMPLES | | | | | | |
|---|---|---|---|---|---|---|---|---|
| | | 1 | 2 | 3 | 4 | 5 | 6 | 7 |
| SOLVENT | % | 0.8 | 0.8 | 0.8 | 0.8 | 0.0 | 0.8 | 0.8 |
| Sodium acetate | % | 0.0 | 0.0 | 0.0 | 0.0 | 0.0 | 0.2 | 0.2 |
| Cleaning Efficacy | % | 55.7 | 51.8 | 56.4 | 52.4 | 51.0 | 60.5 | 62.0 |
| | | 8 | 9 | 10 | 11 | 12 | 13 | |
| SOLVENT | % | 2.0 | 2.0 | 2.0 | 2.0 | 1.6 | 1.6 | |
| Sodium acetate | % | 0.0 | 0.0 | 0.0 | 0.0 | 0.4 | 0.4 | |
| Cleaning Efficacy | % | 70.5 | 65.8 | 56.1 | 53.8 | 72.2 | 83.5 | |
| | | 14 | 15 | 16 | 17 | 18 | 19 | |
| SOLVENT | % | 4.0 | 4.0 | 4.0 | 4.0 | 4.0 | 4.0 | |
| Sodium acetate | % | 0.0 | 0.0 | 0.0 | 0.0 | 1.0 | 1.0 | |
| Cleaning Efficacy | % | 76.1 | 69.5 | 72.9 | 68.6 | 80.2 | 84.4 | |
| | | 20 | 21 | 22 | 23 | 24 | 25 | |
| SOLVENT | % | 6.0 | 6.0 | 6.0 | 6.0 | 4.8 | 4.8 | |
| Sodium acetate | % | 0.0 | 0.0 | 0.0 | 0.0 | 1.2 | 1.2 | |
| Cleaning Efficacy | % | 78.1 | 48.9 | 61.2 | 58.4 | 74.8 | 56.8 | |

As may be seen from the tests, the compositions of the present invention are effective as alkaline cleaning agents for hard surfaces, since they have increased cleaning efficacy when compared with compositions not comprising the mixture of solvents that are at least partially water-miscible and of alkali metal salts of a carboxylic acid.

The invention claimed is:

1. An aqueous base preparation for compositions for cleaning surfaces of refractory materials, comprising at least:

(A) one solvent being at least partially water-miscible which is selected from the group consisting of dioxolanes defined in formula (I) below:

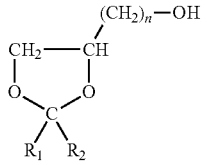

(I)

wherein $R_1$ and $R_2$, which are identical or different, are selected from the group consisting of hydrogen, an alkyl group, an alkenyl group, and a phenyl group; and n is an integer equal to 1, 2, 3, 4, or 5; and (B) an alkali metal salt of a carboxylic acid, wherein the weight percentage of said alkali metal salt of a carboxylic acid is between 2.7% and 10% relative to the total weight of said aqueous base preparation.

2. The aqueous base preparation according to claim 1, further comprising at least one cosolvent selected from the group consisting of dioxolane derivatives, glycol ethers, alcohols, and glycols.

3. The aqueous base preparation according to claim 2, wherein said cosolvent is selected from the group consisting of glycol monoethers, glycol diethers, glycol triethers, C1-C6 alcohols, and C2-C6 glycols.

4. The aqueous base preparation according to claim 1, wherein said dioxolanes are the result of a reaction between glycerol and aldehydes or ketones.

5. The aqueous base preparation according to claim 1, wherein said solvent is a dioxolane selected from the group consisting of 2,2-dimethyl-1,3-dioxolane-4-methanol, 2,2-diisobutyl-1,3-dioxolane-4-methanol, 2-isobutyl-2-methyl-1,3-dioxolane-4-methanol, 2-butyl-2-ethyl-1,3-dioxolane-4-methanol, and 2-phenyl-1,3-dioxolane-4-methanol.

6. The aqueous base preparation according to claim 2, wherein said cosolvent is a glycol ether selected from the group consisting of:

ethylene glycol monobutyl (or n-butyl or t-butyl)ether;
ethylene glycol monoethyl ether;
ethylene glycol monopropyl (or isopropyl)ether;
ethylene glycol monophenyl ether;
ethylene glycol monobenzyl ether;
ethylene glycol hexyl ether;
diethylene glycol monoethyl ether;
diethylene glycol mono-n-butyl ether;
diethylene glycol diethyl ether;
diethylene glycol dimethyl ether;
ethylene glycol diethyl ether;
ethylene glycol dibutyl ether;
ethylene glycol methyl ether acetate;
ethylene glycol monoethyl ether acetate;
ethylene glycol monobutyl ether acetate;
propylene glycol monobutyl (or isobutyl or t-butyl)ether;
propylene glycol monoethyl ether;
propylene glycol monomethyl ether;
propylene glycol mono-n-propyl ether;

propylene glycol monophenyl ether;
propylene glycol dimethyl ether;
dipropylene glycol monomethyl ether; and
triethylene glycol monobutyl ether.

7. The aqueous base preparation according to claim 1, wherein the carboxylic acid in said alkali metal salt of a carboxylic acid comprises from 1 to 10 carbon atoms.

8. A composition for cleaning surfaces of refractory materials, comprising at least:

(A) one solvent being at least partially water-miscible which is selected from the group consisting of dioxolanes of formula (I) shown below:

(I)

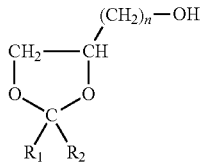

wherein $R_1$ and $R_2$, which are identical or different, are selected from the group consisting of hydrogen, an alkyl group, an alkenyl group, and a phenyl group; and n is an integer equal to 1, 2, 3, 4, or 5;

(B) one alkali metal salt of a carboxylic acid, (C) one surfactant, (D) one basifying agent, and (E) water, wherein said composition comprises at least 85% by weight of said water.

9. The composition according to claim 8, comprising from 0.1% to 2% by weight of said alkali metal salt of a carboxylic acid relative to the total weight of said composition.

10. A method for cleaning surfaces of refractory materials selected from the group consisting of glazed tiles, unglazed tiles, bricks, porcelain, ceramic, stone, marble, granite, glass, metals, and plastics, comprising applying said composition according to claim 8 on a surface to be cleaned.

11. A composition for cleaning surfaces, comprising:

said aqueous base preparation according to claim 1, a surfactant, a basifying agent, and water;

wherein the content of said aqueous base preparation is from 5% to 10% by weight relative to the total weight of said composition.

12. The aqueous base preparation according to claim 1, wherein the carboxylic acid in said alkali metal salt of a carboxylic acid is a C1-C3 monocarboxylic acid.

13. The aqueous base preparation according to claim 1, wherein the alkali metal in said carboxylic acid metal salt is sodium or potassium.

14. The aqueous base preparation according to claim 1, wherein, in said formula (I), said $R_1$ and $R_2$, which are identical or different, are selected from the group consisting of methyl, ethyl, n-propyl, isopropyl, and isobutyl; and wherein n is 1 or 2.

15. The aqueous base preparation according to claim 1, wherein the weight percentage for the solvent (A) relative to the total weight of said base preparation ranges from 77% to 40%.

16. The composition according to claim 8, wherein the content of said solvent (A) is from 0.1% to 6% by weight relative to the total weight of said composition.

17. The composition according to claim 8, wherein said solvent (A) is a dioxolane selected from the group consisting of 2,2-dimethyl-1,3-dioxolane-4-methanol, 2,2-diisobutyl-1,3-dioxolane-4-methanol, 2-isobutyl-2-methyl-1,3-dioxolane-4-methanol, 2-butyl-2-ethyl-1,3-dioxolane-4-methanol, and 2-phenyl-1,3-dioxolane-4-methanol.

18. The composition according to claim 8, wherein the basifying agent is in an amount in said composition to bring the pH of said composition to a value between 8 and 12.

19. The composition according to claim 8, comprising at least 90% by weight of said water.

20. A composition for cleaning surfaces of refractory materials, comprising at least:

(A) one solvent being at least partially water-miscible which is selected from the group consisting of dioxolanes of formula (I) shown below:

(I)

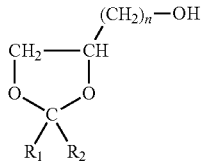

wherein $R_1$ and $R_2$, which are identical or different, are selected from the group consisting of hydrogen, an alkyl group, an alkenyl group, and a phenyl group; and n is an integer equal to 1, 2, 3, 4, or 5;

(B) one alkali metal salt of a carboxylic acid, (C) one surfactant, (D) one basifying agent, and (E) water, wherein said composition comprises from 86% to 97.8% by weight of said water (E) and said basifying agent (D).

* * * * *